US009797694B1

(12) United States Patent
Cummins

(10) Patent No.: US 9,797,694 B1
(45) Date of Patent: Oct. 24, 2017

(54) DURABLE TARGET

(71) Applicant: Timothy Wayne Cummins, Portland, TN (US)

(72) Inventor: Timothy Wayne Cummins, Portland, TN (US)

( * ) Notice: Subject to any disclaimer, the term of this patent is extended or adjusted under 35 U.S.C. 154(b) by 0 days.

(21) Appl. No.: 15/069,664

(22) Filed: Mar. 14, 2016

Related U.S. Application Data

(60) Provisional application No. 62/132,448, filed on Mar. 12, 2015.

(51) Int. Cl.
*F41J 1/10* (2006.01)

(52) U.S. Cl.
CPC ..... *F41J 1/10* (2013.01)

(58) Field of Classification Search
CPC . F41J 1/00; F41J 1/10; F41J 9/02; F41J 7/04; A63B 63/06
USPC ..... 273/390–392, 403–408, 359
See application file for complete search history.

(56) References Cited

U.S. PATENT DOCUMENTS 3,866,652 A 2/1975 Ahmad
3,917,270 A * 11/1975 Gothard, Jr. ..... F41J 9/02 273/359
4,155,554 A * 5/1979 Adamski ..... B60P 1/28 102/362
4,266,780 A * 5/1981 McQuary ..... F41J 3/0076 235/121
4,285,854 A 8/1981 Kageyama
5,405,673 A 4/1995 Seibert
5,433,451 A * 7/1995 De Vries ..... F41J 7/04 273/392
5,486,425 A 1/1996 Seibert
5,676,378 A * 10/1997 West ..... F41J 1/10 273/390
5,775,698 A * 7/1998 Jones ..... F41J 9/02 273/359
5,816,579 A * 10/1998 Broussard ..... F41J 1/01 273/407
5,967,523 A * 10/1999 Brownlee ..... F41J 1/10 273/407
6,435,512 B1 * 8/2002 Beckwith, Sr. ..... F41J 1/10 273/403
7,066,724 B2 6/2006 Danules
7,694,973 B1 * 4/2010 Hofmeister ..... F41J 7/06 273/391
7,984,910 B1 * 7/2011 Nielsen ..... A63B 63/00 273/359
8,757,626 B2 6/2014 Acker
(Continued)

OTHER PUBLICATIONS

Rubber Dummies, available at https://rubberdummies.com/ (last accessed Mar. 14, 2016).

*Primary Examiner* — Mark Graham
(74) *Attorney, Agent, or Firm* — Shane V. Cortesi

(57) ABSTRACT

Long-lasting targets that can be repeatedly used (e.g., shot with a firearm) are disclosed. In some embodiments, the target includes a base that optionally has wheels, at least one post assembly comprising a bottom end connected to the base and a top end, and a target body connected to the at least one post assembly. Optionally, the target body is comprised of a polyurethane. Optionally, the target includes two post assemblies and the target has an expanded position for use and a collapsed position for storage. Methods of preparing targets using a mold are also described herein.

10 Claims, 7 Drawing Sheets

(56) References Cited

U.S. PATENT DOCUMENTS

| | | | | |
|---|---|---|---|---|
| 2010/0032906 | A1* | 2/2010 | Wilcox | F41J 7/04 273/391 |
| 2011/0089639 | A1* | 4/2011 | Bellamy | F41J 9/02 273/359 |
| 2011/0175294 | A1* | 7/2011 | Amodt | F41J 1/10 273/407 |
| 2012/0208150 | A1* | 8/2012 | Spychaiski | F41H 7/005 434/20 |
| 2014/0008870 | A1 | 1/2014 | Jensen | |
| 2015/0184984 | A1* | 7/2015 | Johnson | F41J 1/10 273/359 |
| 2015/0330747 | A1* | 11/2015 | Ferrell | F41J 1/10 273/407 |

* cited by examiner

DURABLE TARGET

RELATED APPLICATIONS

This application claims priority under 35 USC 119 to U.S. Patent Provisional Application No. 62/132,448, filed Mar. 12, 2015, the contents of which are incorporated herein by reference in their entirety.

BACKGROUND

Technical Field

The present invention relates to targets, more particularly, to targets that can be repeatedly used without wearing out.

Background of the Invention

A familiar target at shooting ranges is a piece of paper with a bulls eye that is mounted to a pulley system that allows the marksman to pull the paper target in after he/she is finished to review his/her performance.

U.S. Pat. No. 8,757,626 (the '626 patent) teaches a target that is made of a 1) a target body in the form of a foam block; 2) a single "self-sealing layer" covering the front face of the target body; and 3) a single fabric layer covering the single self-sealing layer. According to the '626 patent, when the an arrow passes through the fabric layer and the self-sealing layer, the self-sealing layer self seals as the arrow becomes embedded in the target body. An image is provided on the fabric layer of the target preferably by a dye sublimation process. According to the '626 patent, the combination of the self-sealing material and the manner in which the image is applied to the target material permits repeated use of the target. The self-sealing material is preferably small cell, cellular plastic or rubber, such as open cell styrene butadiene rubber (SBR) or open cell styrene. Unfortunately, because the arrows become embedded in the target body, they must be removed when the target body becomes filled with arrows, which could damage the target body.

U.S. Patent Publication No. 2014/0008870 (the '870 publication) teaches a bulls eye acoustic target that includes an insulating body member made of a particular type of polystyrene (namely, extruded polystyrene foam having a density in the range of 20-70 kg/m3, preferably, 28-38 kg/m3) covered by a thermoplastic polymer such as polypropylene. According to the '870 publication, the target does not crumble when in use and the insulating body member is made of a material that is capable of allowing the projectile to penetrate the insulating body member and keeping that portion of the insulating body member that has been in contact with the penetrating projectile mechanically connected to the remaining portion of the insulating body member.

While, such bulls eye targets are widely used, it is desirable to create targets that mimic live animals to create a more realistic experience. Most interactive targets that offer realism, however, do not offer durability and would fail after a very short period of use. By design, rounds that are discharged from firearms are destructive by nature. Accordingly, targets made of wood, paper, foam, and most plastics degenerate quickly when being repeatedly fired at in training and recreational shooting.

U.S. Pat. No. 5,486,425 (the '425 patent) describes a self-sealing target that includes a body of an ionomeric polymer such as a co-polymer of ethylene and a vinyl monomer having an acidic group. An example of such a polymer is SURLYN (Dupont Corporation, Wilmington Del.). According to the '425 patent, SURLYN has a normal density of 0.95 g/cm$^3$ and a Shore D hardness of 65. As described in the '425 patent, the ionomeric material may also be vacuum formed into a three dimensional structure of a particular desired shape and size such as a humanoid for use in military and training application. The '425 patent, however, does not describe the durability of the targets in detail, and further does not provide a detailed explanation on whether the targets offer a realistic targeting experience, other than its shape.

Thus, there is a continuing need in the art for targets that are durable and mimic the body of an animal.

BRIEF SUMMARY

The present disclosure provides a target. In some embodiments, the target includes: a) a base comprising a bottom surface configured to face the ground, a top surface opposite the bottom surface, a forward end, a rear end, a base length extending from the forward end to the rear end, a left side, a right side, and a base width extending from the left side to the right side; b) at least one post assembly comprising a bottom end connected to the base, a top end and a height extending from the bottom end to the top end; and c) a target body comprised of a polyurethane and connected to the at least one post assembly (more preferably the top end of the at least one post assembly), the target body having a bottom end, a top end, a height extending from the bottom end to the top end, a front end, a rear end, a thickness extending from the front end to the rear end, a left side, a right side, and a width extending from the left side to the right side.

Optionally, the polyurethane comprises at least about 75% by weight of the target body. Optionally, the target body has a durometer (Shore A) of from about 5 to about 45 (more preferably from about 5 to about 40, even more preferably from about 5 to about 35). Optionally, the target further comprises at least one wheel (preferably three wheels) attached to the base and configured to move the base along the ground. Optionally, the at least one wheel is a caster wheel. Optionally, the base comprises two wheels located adjacent to an end of the base and a caster wheel adjacent to an opposite end of the base. Optionally, the base comprises two wheels located approximately in the center of the base, a front caster wheel adjacent to the front end of the base, and a rear caster wheel adjacent to the rear end of the base. Optionally, the base further comprises a motor configured to move the at least one wheel and a power source configured to power the motor. Optionally, the at least one post assembly is generally cylindrical. Optionally, the target comprises two post assemblies, each post assembly comprising a bottom end connected to the base, a top end and a height extending from the bottom end to the top end. Optionally, each post assembly extends between about 50% and about the 125% of the height of the target body (more preferably between about 50% and about 100% of the height of the target body, even more preferably between about 50 and about 90% of the height of the target body). Optionally, each post assembly is located approximately in the middle of the target body thickness. Optionally, the post assemblies are generally the same height. Optionally, the target has a height extending from the base to the top of the target body of from about 3 feet to about 8 feet. Optionally, the target body has a median thickness of from about 8 inches to about 24 inches and a median width of from about 12 inches to about 36 inches. Optionally, the target body is generally in the shape of a body of an animal. Optionally, the at least one post assembly comprises a bottom post connected to the base and a top post connected to the target body and further wherein the bottom post comprises a hollow interior and the top post is configured to partially nest in the bottom post interior and move relative to the bottom post. Optionally, moving the top post relative to the bottom post is configured to change the height of the target. Optionally, the target further comprises a motor configured to move the top post relative to the bottom post and a power source configured to power the motor. Optionally, the target further comprises a left flange extending generally upwardly from the base left side, a right flange extending generally upwardly from the base right side, an aperture located in each flange, a hollow horizontal bar generally parallel to the target width and traversing the base, and a pin configured to be removably inserted through the flange apertures and through the hollow horizontal bar. Optionally, the target comprises an expanded position in which the pin is inserted through the flange apertures and through the hollow horizontal bar and in which the at least one post assembly is generally perpendicular to the base and further wherein the target comprises a collapsed position in which the pin is removed from the hollow horizontal bar and in which the at least one post assembly is at an angle of between about 0 degrees and about 45 degrees relative to the base. Optionally, the target further comprises a spring having a forward end connected to the at least one post assembly and a rear end connected to the base. Optionally, the base is generally rectangular in shape. Optionally, the target body glows green when irradiated with only black light. Optionally, the target body glows blue when irradiated with black light and white light. Optionally, the target is used in a method that includes: a) providing the target; and b) aiming a fighting implement towards the target. Optionally, the fighting implement is metallic. Optionally, the fighting implement is selected from the group consisting of a sword, a bow, and a bullet. Optionally, the method further comprises irradiating the target body with black light.

In some embodiments, the target includes: a) a base comprising a bottom surface configured to face the ground, a top surface opposite the bottom surface, a forward end, a rear end, a base length extending from the forward end to the rear end, a left side, a right side, and a base width extending from the left side to the right side; b) a left post assembly and a right post assembly, each post assembly generally cylindrical in shape and comprising a bottom end connected to the base, a top end and a height extending from the bottom end to the top end; and c) a target body connected to the left post assembly and the right post assembly, the target body having a bottom end, a top end, a height extending from the bottom end to the top end, a front end, a rear end, a thickness extending from the front end to the rear end, a left side, a right side, and a width extending from the left side to the right side. The target may include one or more of the components described above including without limitation the characteristics of the target body described above, and the wheel, the motor, the post assemblies, the flanges, the pin and the horizontal bar described above.

In still further embodiments, the target includes: a) a base comprising a bottom surface configured to face the ground, a top surface opposite the bottom surface, a forward end, a rear end, a base length extending from the forward end to the rear end, a left side, a right side, and a base width extending from the left side to the right side, at least one wheel attached to the base and configured to move the base along the ground, and a first motor configured to move the at least one wheel and a first power source configured to power the first motor; b) at least one post assembly comprising a bottom end connected to the base, a top end and a height extending from the bottom end to the top end; and c) a target body comprised of a polyurethane and connected to the at least one post assembly, the target body having a bottom end, a top end, a height extending from the bottom end to the top end, a front end, a rear end, a thickness extending from the front end to the rear end, a left side, a right side, and a width extending from the left side to the right side.

The target may include one or more of the components described above including without limitation the characteristics of the target body described above, and the post assemblies, the flanges, the pin and the horizontal bar described above. Optionally, the base further comprises a base microprocessor configured to control the first motor and a receiver in electronic communication with the remote control microprocessor and the system further comprises a remote control comprising a remote control microprocessor configured to control the base microprocessor and the first motor, a transmitter configured to transmit control signals from the remote control microprocessor to the receiver and a second power source configured to power the remote control microprocessor. Optionally, the target comprises a bottom post connected to the base and a top post connected to the target body, wherein the bottom post comprises a hollow interior and the top post is configured to partially nest in the bottom post interior and move relative to the bottom post, wherein moving the top post relative to the bottom post is configured to change the height of the target, and wherein the target further comprises a second motor configured to move the top post relative to the bottom post and a third power source configured to power the second motor, and further wherein the remote control microprocessor is configured to control the second motor.

Optionally, the target is prepared by a method that includes: a) providing a mold in the shape of a body of an animal; b) mixing a polyol, a diisocyanate and a catalyst to form a mixture in the mold; and c) allowing the mixture to form a polyurethane in the shape of a body of an animal. Optionally, the method further includes the step of heating the mixture after step b). Optionally, the polyurethane in the shape of a body of an animal has a durometer shore A of from about 5 to about 45. Optionally, the diisocyanate is tolylene diisocyanate. Optionally, the mold comprises a top end, a bottom end comprising at least one aperture, a height extending from the top end to the bottom end, a front end, a rear end, a thickness extending from the front end to the rear end, a left side, a right side, and a width extending from the left side to the right side, and further wherein the method further comprises inserting a post assembly through the at least one aperture prior to or during step c). Optionally, the post assembly is generally cylindrical in shape. Optionally, the post assembly is inserted through the at least one aperture so that the post assembly extends between about 50% and about 125% of the height of the mold (more preferably between about 50% and about 100% of the height of the mold, even more preferably between about 50 and about 90% of the height of the target body). Optionally, the bottom end comprises two apertures and the method further comprises providing two post assemblies and inserting a post assembly through each aperture prior to or during step c). Optionally, the mold is generally hollow prior to step b). Optionally, the rear side is generally open prior to step b).

In some embodiments, the polyurethane of the target body allows bullets to pass through and self-heals. The target body may be used in a combination with a variety of different caliber bullets and from a variety of different distances.

BRIEF DESCRIPTION OF THE DRAWINGS

in FIG. 1, the target is in the expanded position.

in FIG. 2, the target is in the expanded position.

in FIG. 3, the target is in the expanded position.

in FIG. 4, the target is in the collapsed position.

in FIG. 5, the target is in the collapsed position and the pin has been re-inserted through the flange apertures.

DETAILED DESCRIPTION

Figure 1:
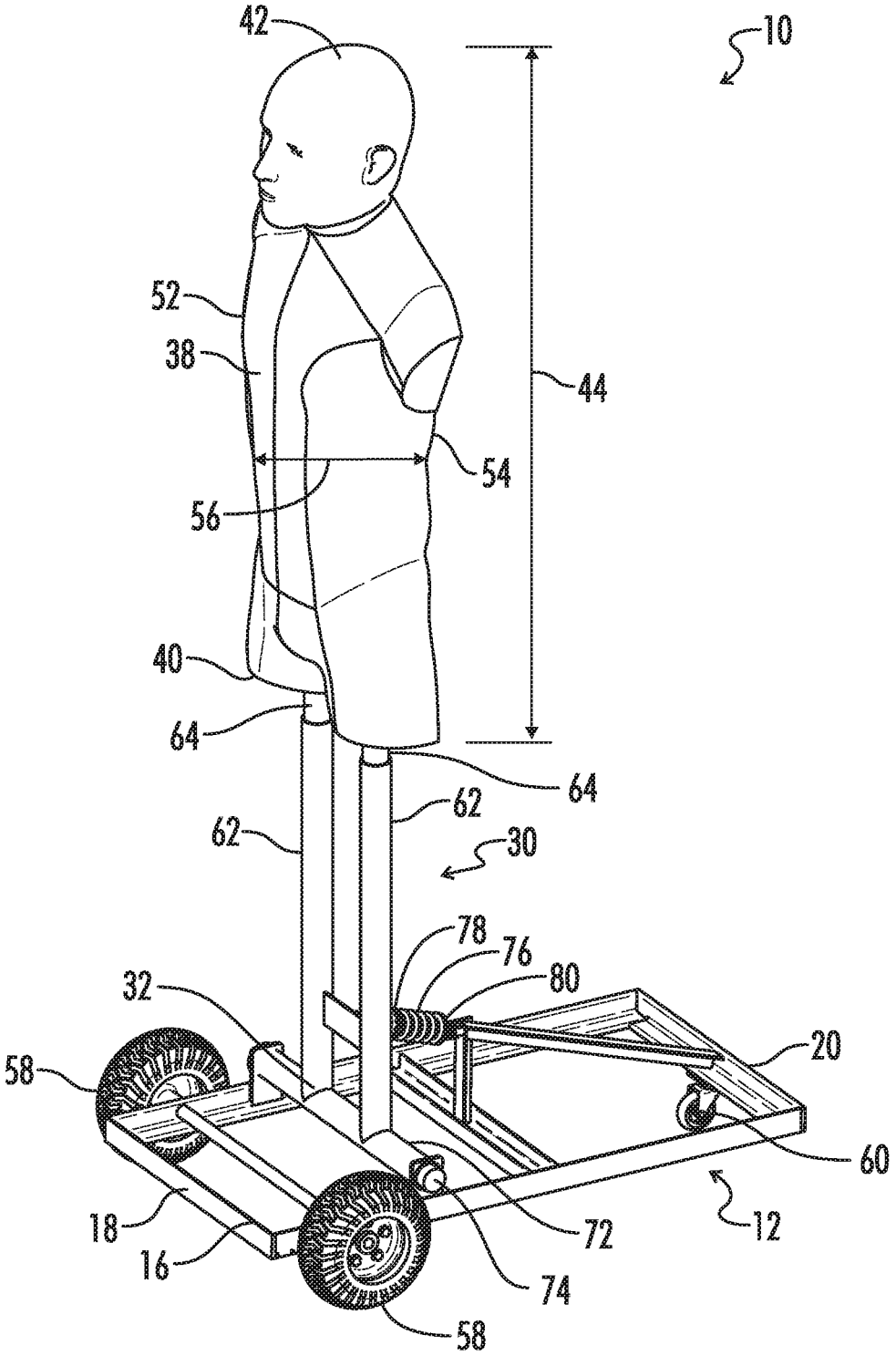
FIG. 1 illustrates a right side perspective view of a target of one embodiment of the present invention.
Figure 2:
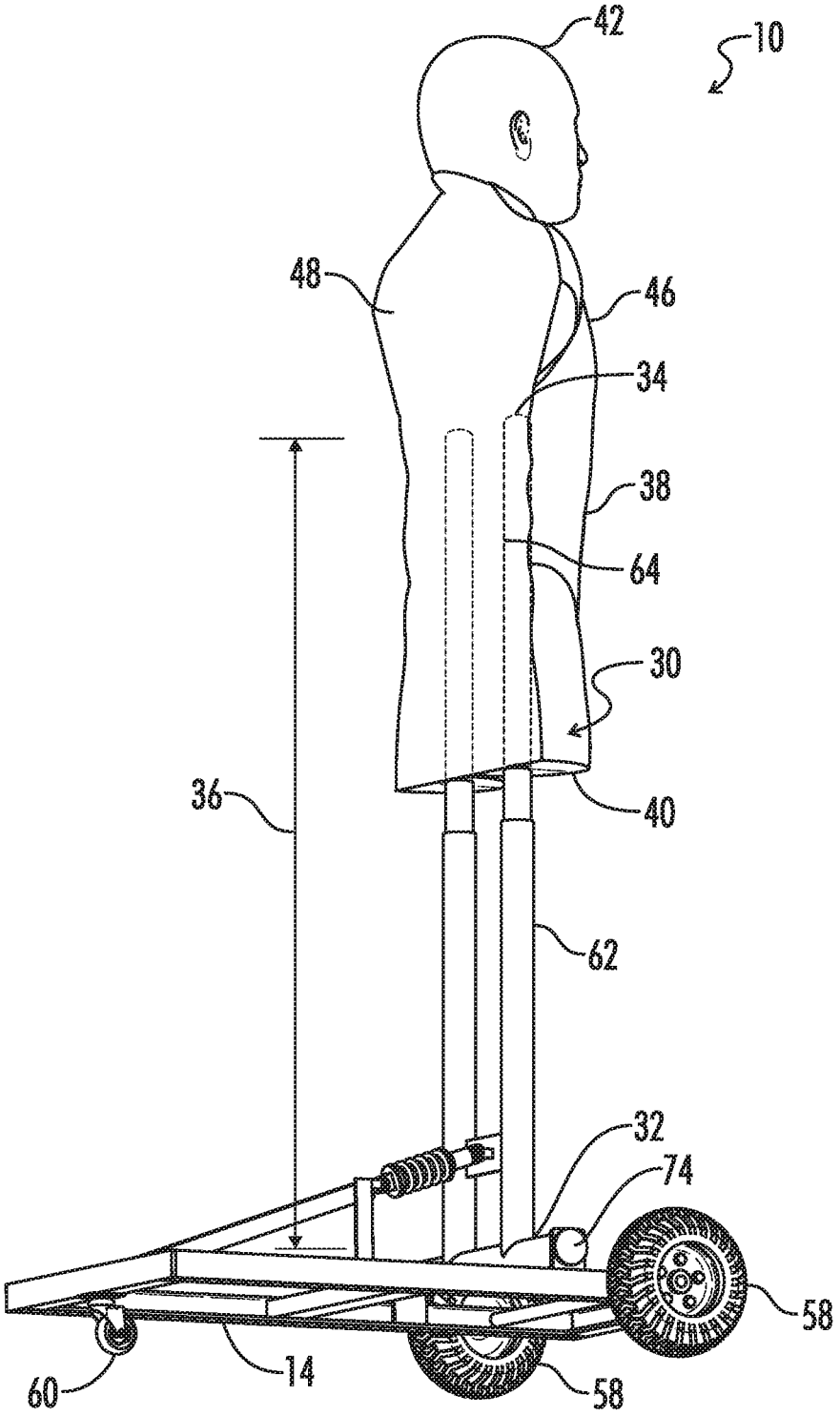
FIG. 2 illustrates a left side perspective view of the target of FIG. 1.
Figure 3:
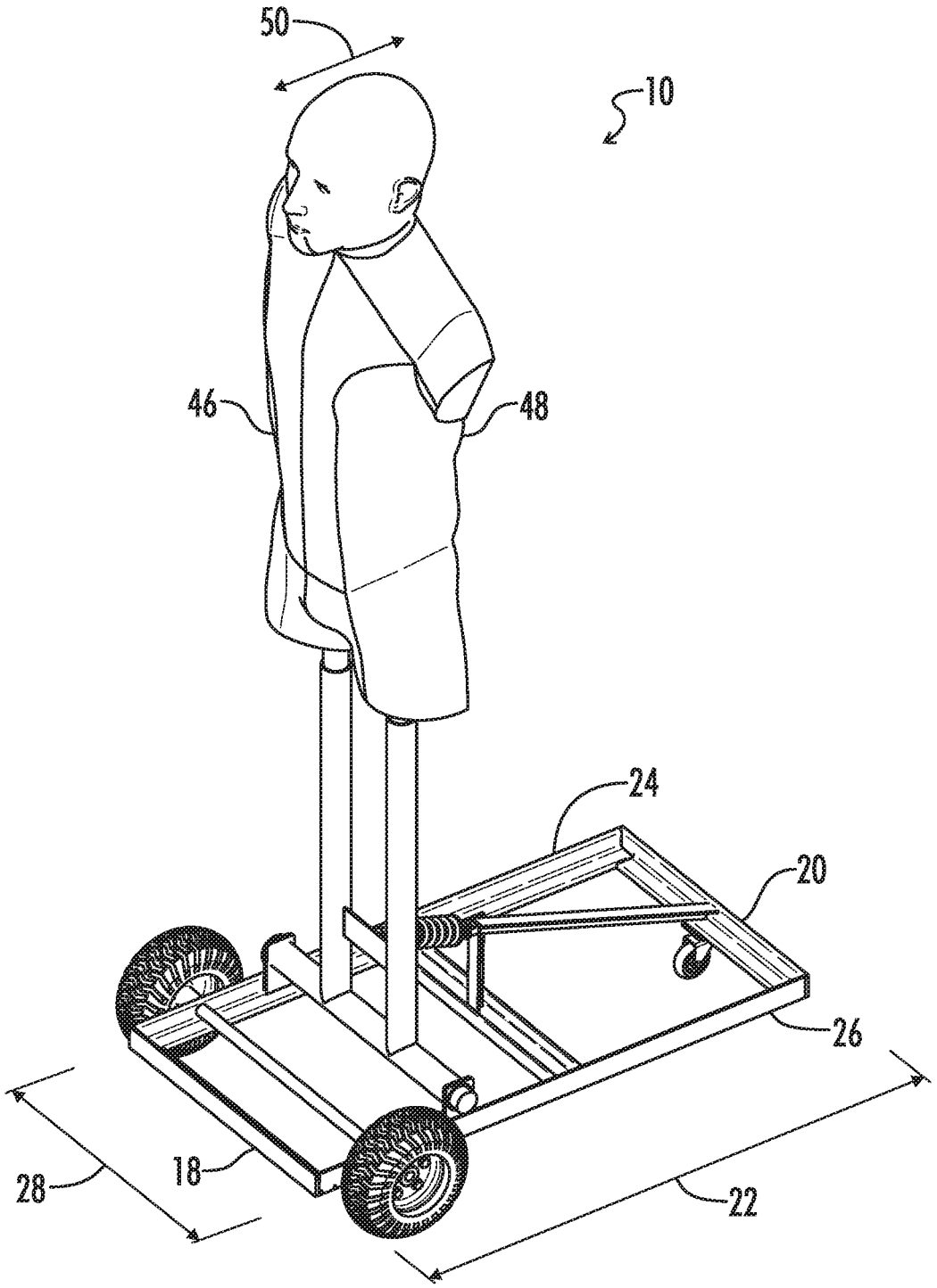
FIG. 3 illustrates another right side perspective view of the target of FIG. 1.
Figure 4:
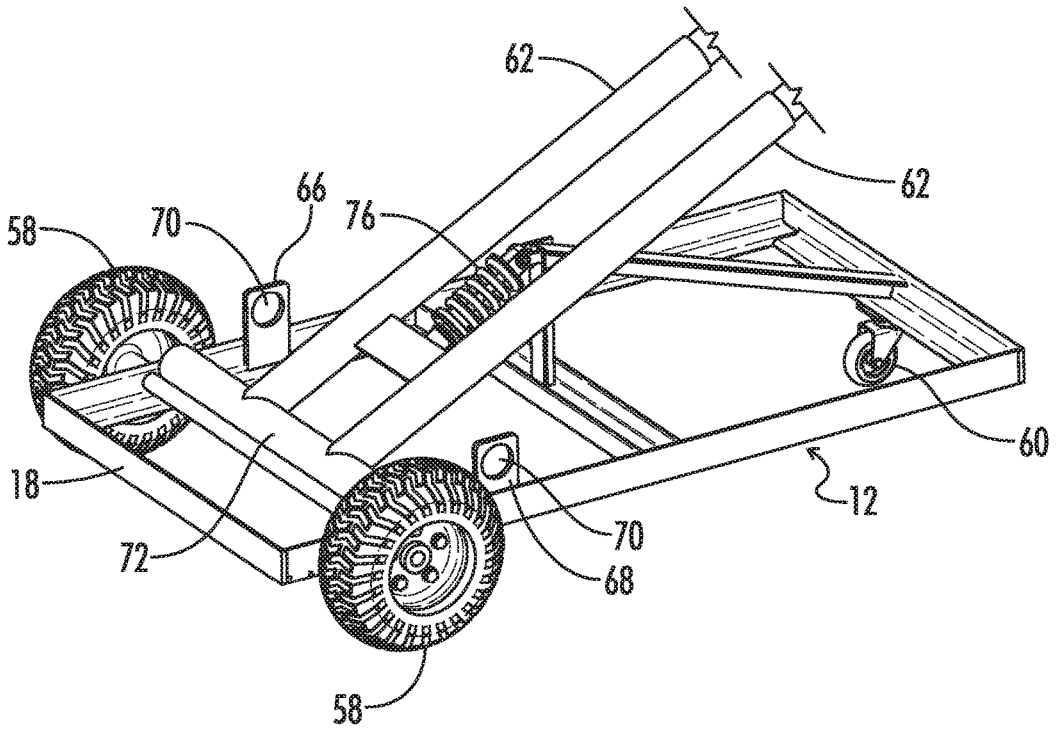
FIG. 4 illustrates a right side perspective view of the base and bottom posts of the target of FIG. 1.

With reference to FIGS. 1-7 the present disclosure provides a target generally designated by the numeral 10. In the drawings, not all reference numbers are included in each drawing for the sake of clarity.

Referring to FIGS. 1-7, in some embodiments, the present disclosure provides a target 10 that includes:

a) a base 12 comprising a bottom surface 14 configured to face the ground, a top surface 16 opposite the bottom surface 14, a forward end 18, a rear end 20, a base length 22 extending from the forward end 18 to the rear end 20, a left side 24, a right side 26, and a base width 28 extending from the left side 24 to the right side 26;

b) at least one post assembly 30 comprising a bottom end 32 connected to the base 12, a top end 34 and a height 36 extending from the bottom end 32 to the top end 34; and c) a target body 38 connected to the at least one post assembly 30 so that the at least one post assembly 30 extends at least partially through the target body 38, the target body 38 having a bottom end 40, a top end 42, a height 44 extending from the bottom end 40 to the top end 42, a front end 46, a rear end 48, a thickness 50 extending from the front end 46 to the rear end 48, a left side 52, a right side 54, and a width 56 extending from the left side 52 to the right side 54. Optionally, the target body 38 is connected to the top end 34 of the at least one post assembly 30. For example, the target body 38 may form around and enclose the top end 34 of the at least one post assembly 30 if a mold is used as described below.

Optionally, the target body 38 is comprised of a synthetic polyurethane. Optionally, the polyurethane comprises at least about 75% by weight of the target body 38. Optionally, the target body 38 has a durometer (Shore A) of from about 5 to about 45. Prototypes have been constructed as illustrated in FIGS. 1-6 by mixing either TYRFIL LD Prepolymer and TYRFIL LD Catalyst or TYRFIL MG-30 Prepolymer and TYRFIL MG-30 Catalyst (Pathway Polymers, Chattanooga Tenn.) in a humanoid mold, and letting the material cure pursuant to the manufacturer's instructions to form the target body 38. It has been found that a target body 38 prepared by mixing TYRFIL LD Prepolymer and TYRFIL LD Catalyst is particularly durable, as such a target body 38 has withstood approximately 3,000 total shots from a combination of different firearms (.22, 38, 9 mm. 10 mm., 45, 5.56, .223, 380, 30/30, 12 gauge slug and 9 pellet 00, and .308) and stayed intact. In addition, it has been found that a target body 38 prepared by mixing TYRFIL MG-30 Prepolymer and TYRFIL MG-30 Catalyst is particularly durable, as such a target body 38 has withstood approximately 1,000 rounds of ammunition and shown little signs of wear. It is preferred that a shooter shots no closer than four feet to the target body 38. Preferably, the target body 38 has physical and chemical characteristics very similar to the end product prepared by mixing either TYRFIL LD Prepolymer and TYRFIL LD Catalyst or TYRFIL MG-30 Prepolymer and TYRFIL MG-30 Catalyst (Pathway Polymers, Chattanooga Tenn.) and curing the mixture according to the manufacturer's instructions (e.g., a density within 5% of the density of TYRFIL LD or TYRFIL MG-30 final product).

TYRFIL is described in for example U.S. Pat. No. 3,866,652, the entire contents of which are incorporated herein by reference, where TYRFIL is described as the reaction product of (A) a polypropylene glycol having an average molecular weight in the range of about 1,800 to 2,400 and containing free hydroxyl functionality of about 0.9 to about 1.1 meg/gm of polypropylene glycol, and (B) a prepolymer of (1) an excess of a mixture of the 2,4 and 2,6 isomers of toluene diisocyanate and (2) said polypropylene glycol with the prepolymer containing free isocyanate functionality of about 0.9 to about 1.1 meg/gm of prepolymer. TYRFIL is also described in U.S. Pat. No. 4,285,854, the entire contents of which are incorporated herein by reference, where it is said TYRFIL is prepared from a polyester or polyether having a terminal hydroxyl group (hereinafter referred to as "—OH group") and a diisocyanate, that is, polyurethane having a polyether or polyester as the skeleton. According to U.S. Pat. No. 4,285,854, TYRFIL is said to be a reaction product of a mixture of polyoxypropylene glycol and polyoxypropylene triol with tolylene diisocyanate (TDI). Additional information concerning reaction mixtures of polyols and isocyanates is found in U.S. Pat. No. 7,066,724, the entire contents of which are incorporated herein by reference.

Optionally, the target body 38 is located closer to the base front 18 than the base rear 20. The target body 38 usually is solid and opaque and covers the tops of the post assemblies 30; however, in FIGS. 2 and 3, the post assemblies 30 are partially shown through the target body 38 for illustration purposes only.

Figure 5:
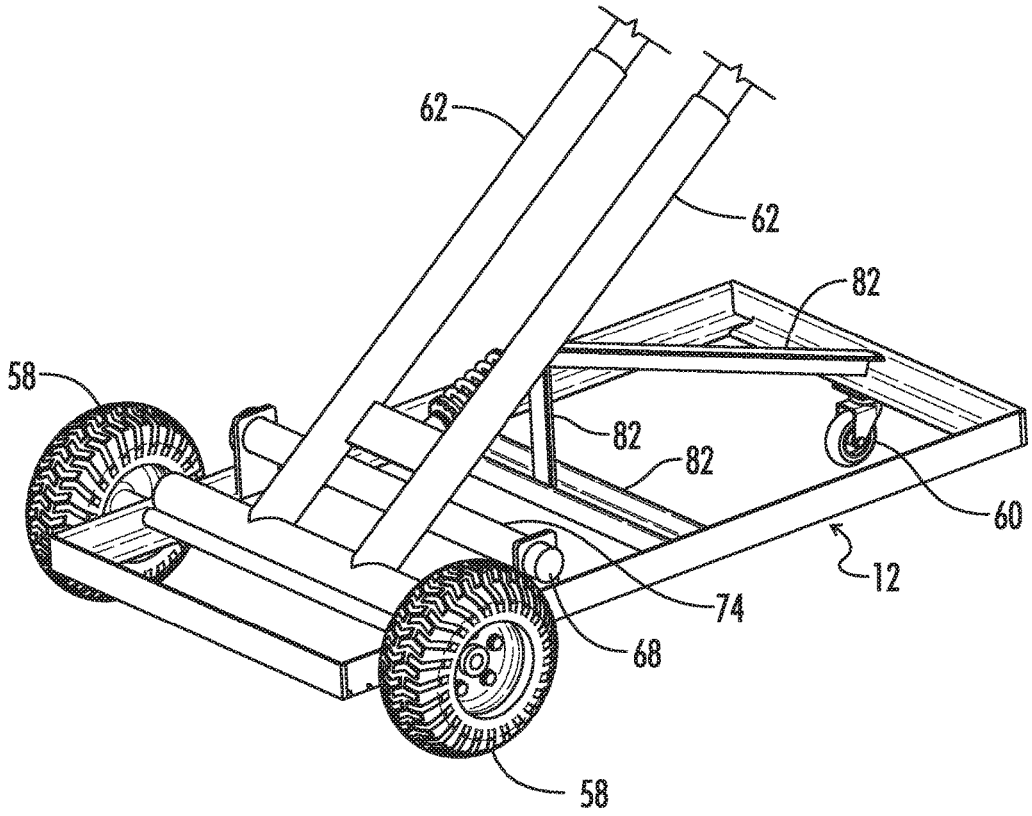
FIG. 5 illustrates a right side perspective view of the base and bottom posts of the target of FIG. 1.
Figure 6:
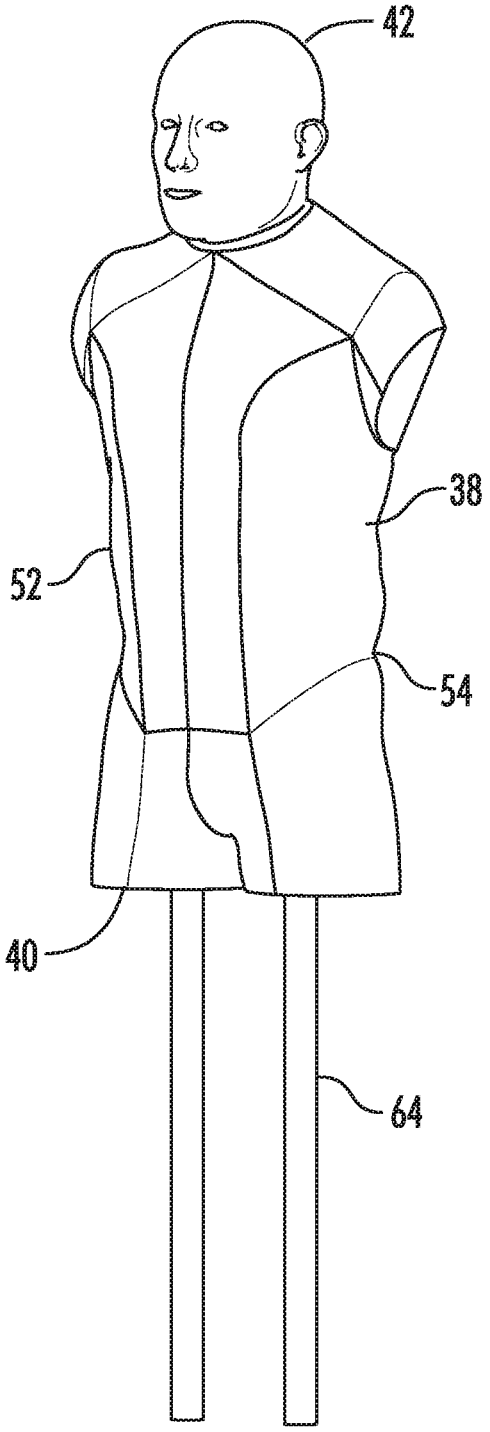
FIG. 6 illustrates a front elevation view of the target body and bottom post of the target of FIG. 1.
Figure 7:
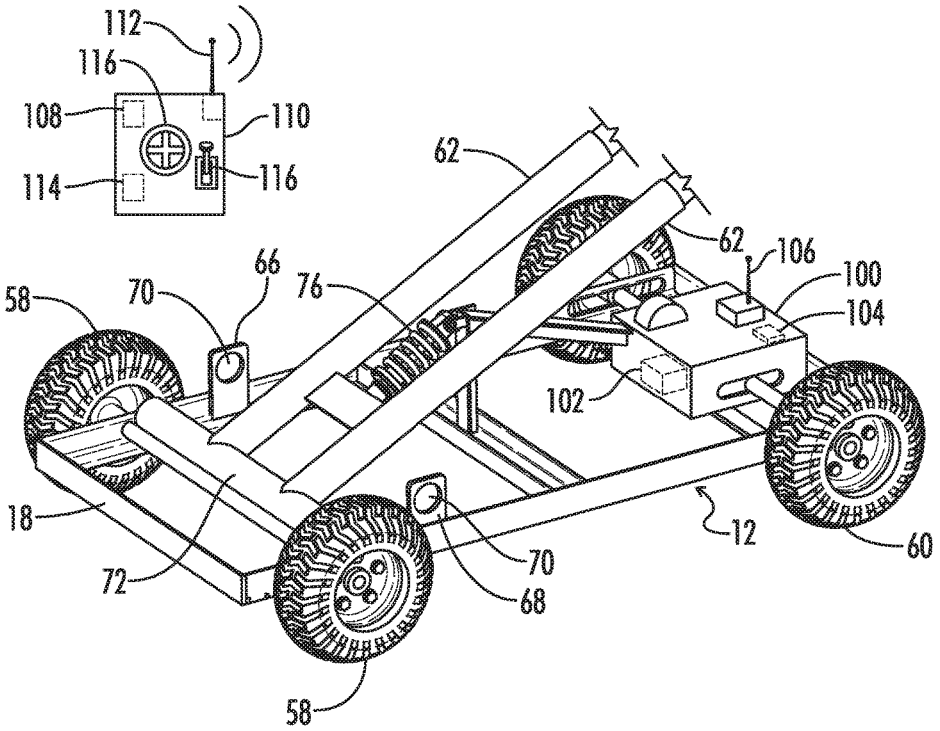
FIG. 7 illustrates a right side perspective view of a target base, bottom posts and remote control of another embodiment of the present invention.

Optionally, the target 10 includes at least one wheel attached to the base 12 and configured to move the base 12 along the ground. For example, the base 12 may include two regular wheels 58 (that rotate on an axis like a vehicle wheel) and one or two caster wheels 60. Optionally, the base 12 comprises two regular wheels 58 located adjacent to an end (18 or 20 of the base 12 and a caster wheel 60 adjacent to an opposite end (18 or 20) of the base 12, as shown in FIGS. 1-5, which is advantageous in that the target body 38 can be easily moved by tilting the target body 38 forwardly and placing all of the weight on the two regular wheels 58. Alternatively, the base 12 may comprise two regular wheels 58 located approximately in the lengthwise center of the base 12, a front caster wheel 60 adjacent to the front end 18 of the base 12, and a rear caster wheel 60 adjacent to the rear end 20 of the base 12. Alternatively, the base 12 may comprise four regular wheels 58, as shown in FIG. 7—i.e., two regular wheels 58 at the forward end 18 and two regular wheels 58 at the rear end 20. Optionally, as shown in FIG. 7, the base 12 further comprises a motor 100 configured to move the regular wheel(s) 58 and a power source 102 configured to power the motor 100. Optionally, the at least one post assembly 30 is generally cylindrical, as shown in FIGS. 1-7. Optionally, the target 10 comprises two post assemblies 30 (namely a left and right post assembly), each post assembly 30 comprising a bottom end 32 connected to the base 12, a top end 34 and a height 36 extending from the bottom end 32 to the top end 34. Optionally, each post assembly 30 extends between about 50% and about 125% (more preferably between about 50% and about 100%) of the height 44 of the target body 38. Optionally, each post assembly 30 is located approximately in the middle of the target body thickness 50. Optionally, the post assemblies 30 are generally the same height. Optionally, the target 10 has a height extending from the base 12 to the top 42 of the target body 38 of from about 3 feet to about 8 feet. Optionally, the target body 38 has a median thickness 50 of from about 8 inches to about 24 inches and a median width 56 of from about 12 inches to about 36 inches. Optionally, the target body 38 is generally in the shape of a body of an animal (e.g., humanoid or in the shape of a deer or another game). Each post assembly 30 may be a single post or formed by a plurality of posts. For example, each one post assembly 30 may comprise a bottom post 62 connected to the base 12 and a top post 64 connected to the target body 38 and further wherein the bottom post 62 comprises a hollow interior and the top post 64 is configured to partially nest in the bottom post 62 interior and move relative to the bottom post 62 and moving the top post 64 relative to the bottom post 62 is configured to change the height 44 of the target 12. (It will be understood that in order for the top post 64 to nest in the bottom post 62, the height of the top post 64 should be greater than the height of the bottom post 62). Optionally, the post assembly 30 comprises a pin aperture and pin so that the target height 44 can be adjusted like a basketball hoop. Optionally, the target 12 further comprises a motor configured to move the top post 64 relative to the bottom post 62 and a power source configured to power the motor. Optionally, the target 12 further comprises a left flange 66 extending generally upwardly from the base left side 24, a right flange 68 extending generally upwardly from the base right side 26, an aperture 70 located in each flange 66 and 68, a hollow horizontal bar 72 generally parallel to the target width 56 and the base width 28, the hollow horizontal bar 72 traversing the base 12, and the target 10 further includes a pin 74 configured to be removably inserted through the flange apertures 70 and through the hollow horizontal bar 72. Optionally, the target 10 comprises an expanded position (see FIGS. 1-3) in which the pin 74 is inserted through the flange apertures 70 and through the hollow horizontal bar 72 and in which the at least one post assembly 30 is generally perpendicular to the base 12 and further wherein the target 10 comprises a collapsed position (see FIGS. 4 and 5) in which the pin 74 is removed from the hollow horizontal bar 72 and in which the at least one post assembly 30 is at an angle of between about 0 degrees and about 45 degrees relative to the base 12. In FIG. 5, the pin 74 has been re-inserted through the flange apertures 70 but not through the hollow horizontal bar 72 for storage. As will be appreciated, the pin 74 and hollow horizontal bar 72 are generally cylindrical in shape with the outer diameter of the pin 74 for at least the majority of the length of the pin 74 being less than the inner diameter of the hollow horizontal bar 72 so that the pin 74 nests inside the horizontal bar 72, it being understood that the pin 74 may have an enlarged left or right end.

Optionally, the target 10 further comprises a shock/spring 76 having a forward end 78 connected to the at least one post assembly 30 and a rear end 80 connected to the base 12. The shock/spring 76 acts as a vertical stabilizer and to allow motion when the target body 38 is struck by a projectile. Optionally, the base 12 is generally rectangular in shape. Optionally, the target 10 may include plurality of braces 82.

Optionally, if the wheels 58 are motorized (e.g., by the wheel motor 100 rotating an axle), the base 12 further comprises a base microprocessor 104 configured to control the wheel motor 100 and a receiver 106. As mentioned above, a wheel power source 102 (e.g., a battery) powers the wheel motor 100. A remote control 110 may be used to control the wheel motor 100. More particularly, the remote control 110 may be in electronic communication with the remote control microprocessor 108 of the remote control 110. The remote control microprocessor 108 is configured to control the base microprocessor 104 and the wheel motor 100. More particularly, the remote control 110 may also include a transmitter 112 configured to transmit control signals from the remote control microprocessor 108 to the receiver 106. The remote control 110 may also include a remote control power source 114 (e.g., battery) configured to power the remote control microprocessor 108. The remote control 110 also includes one or more controls 116 (e.g., buttons). Optionally, the target 12 further comprises a second motor (not shown) configured to move the top post 64 relative to the bottom post 62 and a third power source (not shown) configured to power the second motor, and the remote control microprocessor is configured to control the second motor.

It has been observed that the target body 38 glows green when irradiated with only black light when the target body 38 is made of TYRFIL MG-30. It has also been observed that the target body 38 glows blue when irradiated with black light and white light.

Optionally, the target 10 is used in a method that includes: a) providing the target 10; and b) aiming a fighting implement towards the target 10 (more particularly toward target body 38). Optionally, the fighting implement is metallic. Optionally, the fighting implement is selected from the group consisting of a sword, a bow, and a bullet.

The targets 10 can be made by any suitable method. Optionally, the target 10 is prepared by a method that includes:

a) providing a mold in the shape of a body of an animal;

b) adding a polyol, an isocyanate (more preferably a diisocyanate) and a catalyst to the mold to form a mixture; and c) allowing the mixture to form a polyurethane in the shape of a body of an animal.

Optionally, the method further includes heating the mixture after step b). Optionally, the polyurethane in the shape of a body of an animal has a durometer Shore A of from about 5 to about 45. Optionally, the diisocyanate is tolylene diisocyanate. Optionally, the mold comprises a top end, a bottom end comprising at least one aperture, a height extending from the top end to the bottom end, a front end, a rear end, a thickness extending from the front end to the rear end, a left side, a right side, and a width extending from the left side to the right side, and further wherein the method further comprises inserting a post assembly 30 through the at least one aperture prior to or during step c). Optionally, the post assembly 30 is generally cylindrical in shape. Optionally, the post assembly 30 is inserted through the at least one aperture so that the post assembly 30 extends between about 50% and about 125% of the height of the mold (more preferably between about 50% and about 100% of the height of the mold). Optionally, the bottom end comprises two apertures and the method further comprises providing two post assemblies 30 and inserting a post assembly 30 through each aperture prior to or during step c). Optionally, the mold is generally hollow prior to step b). Optionally, the rear side is generally open prior to step b). Optionally, the method further includes connecting the post assembly 20 to a base 12.

While the targets 10 described herein have been described particularly as being useful with firearms, it will appreciated that the targets 10 may also be used to absorb swords and bows, for example, in sword and archery training.

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A target comprising:

a) a base comprising a bottom surface configured to face the ground, a top surface opposite the bottom surface, a forward end, a rear end, a base length extending from the forward end to the rear end, a left side comprising a left wheel, a right side comprising a right wheel opposite the left wheel, the left wheel and the right wheel sharing a common axle, a base width extending from the left side to the right side, a left flange extending generally upwardly from the base left side, a right flange extending generally upwardly from the base right side, an aperture located in each flange, a hollow horizontal bar generally parallel to the target width and traversing the base, and a horizontal pin configured to be removably inserted from the left flange aperture through the horizontal bar and through the right flange aperture, wherein the base further comprises a vertical brace extending generally upward from the base and located rearwardly relative to the hollow horizontal bar;

b) a post assembly comprising a left vertical post comprising a bottom end connected to the hollow horizontal bar and a top end, a right vertical post comprising a bottom end connected to the hollow horizontal bar and a top end, and a post assembly horizontal bar extending from the left vertical post to the right vertical post generally parallel to the hollow horizontal bar, wherein the left vertical post and the right vertical post are separated by a gap; and c) a target body comprised of a polyurethane and connected to the top ends of the left and right vertical posts, the target body having a bottom end, a top end, a height extending from the bottom end to the top end, a front end, a rear end, a thickness extending from the front end to the rear end, a left side, a right side, and a width extending from the left side to the right side, wherein the left post and right vertical post extend at least partially through the target body, wherein the target further comprises a shock spring having a forward end attached to the post assembly horizontal bar and a rear end attached to the vertical brace, and further wherein the target further comprises an upright position in which the horizontal pin is inserted from the left flange aperture through the hollow horizontal bar and through the right flange aperture and in which the left and right vertical posts extend generally upward and generally perpendicular to the base and further wherein the target comprises a collapsed position in which the pin is removed from the hollow horizontal bar, in which the hollow horizontal bar and the bottom ends of the left and right vertical posts are in front of the left and right flanges, and in which the left and right vertical posts are at an angle of between about 0 degrees and about 45 degrees relative to the base.

2. The target of claim 1, wherein polyurethane comprises at least about 75% by weight of the target body.

3. The target of claim 1, wherein the target body has a durometer (Shore A) of from about 5 to about 45.

4. The target of claim 1, wherein the left and right vertical posts are generally cylindrical.

5. The target of claim 1, wherein the target body is generally in the shape of a body of an animal.

6. The target of claim 1, wherein the left vertical post is comprised of two pieces partially nested inside of each other and further wherein the right vertical post is comprised of two pieces partially nested inside of each other.

7. The target of claim 1, wherein the target further comprises a rear brace having a rear end attached to the base and a forward end attached to the vertical brace, the rear brace extending upward at angle toward the vertical brace.

8. A method of using a target comprising the steps of:

a) providing the target of claim 1; and b) aiming a fighting implement towards the target of claim 1.

9. The method of claim 8 wherein the fighting implement is metallic.

10. The method of claim 8, wherein the fighting implement is selected from the group consisting of a sword, a bow, and a bullet.

* * * * *